US008186754B2

(12) United States Patent
Sharrow

(10) Patent No.: US 8,186,754 B2
(45) Date of Patent: May 29, 2012

(54) WORKER'S BODY SUPPORT

(76) Inventor: Steven Sharrow, Bally, PA (US)

( * ) Notice: Subject to any disclaimer, the term of this patent is extended or adjusted under 35 U.S.C. 154(b) by 152 days.

(21) Appl. No.: 12/761,811

(22) Filed: Apr. 16, 2010

(65) Prior Publication Data

US 2010/0270838 A1 Oct. 28, 2010

Related U.S. Application Data

(60) Provisional application No. 61/172,850, filed on Apr. 27, 2009.

(51) Int. Cl.

| | |
|---|---|
| ***A47C 4/00*** | (2006.01) |
| ***A47C 1/00*** | (2006.01) |
| ***A47C 1/031*** | (2006.01) |
| ***A47C 1/032*** | (2006.01) |

(52) U.S. Cl. ..... 297/23; 297/19; 297/21; 297/22; 297/55; 297/337; 297/338; 297/354.1; 297/354.12; 297/357

(58) Field of Classification Search ..... 297/19, 297/20, 21, 22, 23, 55, 337, 338, 354.1, 354.12, 297/357

See application file for complete search history.

(56) References Cited

U.S. PATENT DOCUMENTS

| | | | | | |
|---|---|---|---|---|---|
| 254,133 | A | * | 2/1882 | Holt | 297/23 X |
| 294,433 | A | * | 3/1884 | Beardsley | 297/23 |
| 316,973 | A | * | 5/1885 | Horn | 297/23 |
| 363,404 | A | * | 5/1887 | Marston | 297/23 |
| 366,980 | A | * | 7/1887 | Shuler | 297/23 |
| 379,670 | A | * | 3/1888 | Whitehead | 297/23 |
| 445,012 | A | * | 1/1891 | Dicks | 297/23 X |
| 534,501 | A | * | 2/1895 | Evers | 297/23 |
| 543,681 | A | * | 7/1895 | Fortier | 297/19 |
| 900,885 | A | * | 10/1908 | Robinson | 297/23 |
| 942,724 | A | * | 12/1909 | Flindall | 297/23 |
| 1,033,108 | A | * | 7/1912 | Lehmann | 297/23 |
| 1,039,078 | A | * | 9/1912 | Arnold | 297/23 X |
| 1,155,366 | A | * | 10/1915 | Myers | 297/23 |
| 1,240,243 | A | * | 9/1917 | Norberti | 297/23 |
| 1,297,088 | A | | 3/1919 | Butler | |
| 1,443,921 | A | * | 1/1923 | MacKenzie | 297/23 |
| 1,462,005 | A | * | 7/1923 | Hall | 297/23 |
| 1,601,043 | A | * | 9/1926 | Schneider | 297/23 |
| 1,882,176 | A | * | 10/1932 | Brown | 297/23 |
| 1,923,517 | A | * | 8/1933 | Swaninger | 297/23 |
| 1,933,040 | A | * | 10/1933 | Baker | 297/23 |
| 1,935,238 | A | * | 11/1933 | Danzer | 297/23 |
| 1,979,278 | A | * | 11/1934 | McMurtry | 297/23 |
| 2,006,823 | A | * | 7/1935 | Beeskow | 297/23 |
| 2,011,874 | A | * | 8/1935 | Ricketts | 297/23 |
| 2,044,364 | A | * | 6/1936 | Parry | 297/23 |
| 2,046,516 | A | | 7/1936 | Johnson | |
| 2,047,178 | A | | 7/1936 | Coninck | |
| 2,052,955 | A | * | 9/1936 | Vanderminden | 297/23 |
| 2,096,169 | A | * | 10/1937 | Friesner | 297/23 |
| 2,137,427 | A | * | 11/1938 | Thomson | 297/23 |

(Continued)

*Primary Examiner* — Rodney B White
(74) *Attorney, Agent, or Firm* — Connolly Bove Lodge & Hutz

(57) ABSTRACT

A worker's body support includes a base assembly which is preferably made of two spaced channel members. An upright assembly also preferably made of two spaced channel members is pivotally mounted at its lower end to the base assembly. An angular adjustment structure is pivotally mounted to the base assembly and is selectively mounted to one of a number of different locations to the upright assembly to adjust the angular orientation of the upright assembly. A seat is mounted to the upright assembly and is movable to a plurality of different locations and orientations.

14 Claims, 22 Drawing Sheets

U.S. PATENT DOCUMENTS

| | | | | | |
|---|---|---|---|---|---|
| 2,381,149 | A | * | 8/1945 | Wenneborg | 297/23 |
| 2,521,412 | A | | 9/1950 | Sack | |
| 2,541,539 | A | * | 2/1951 | Ochoa | 297/23 |
| 2,627,899 | A | * | 2/1953 | Grotefend | 297/23 |
| 2,660,224 | A | * | 11/1953 | Frisch | 297/23 |
| 2,735,479 | A | * | 2/1956 | Bugg | 297/23 |
| 2,806,512 | A | | 9/1957 | Whalen | |
| RE26,070 | E | | 8/1966 | Laughlin | |
| 3,452,372 | A | | 7/1969 | Emery | |
| 3,556,587 | A | | 1/1971 | Rymes | |
| 4,109,961 | A | * | 8/1978 | Opsvik | 297/338 |
| 4,252,367 | A | * | 2/1981 | Vanderminden | 297/23 |
| 4,614,378 | A | * | 9/1986 | Picou | 297/338 X |
| 4,738,487 | A | * | 4/1988 | Shalinsky et al. | 297/338 |
| 4,958,885 | A | * | 9/1990 | Kassai | 297/55 |
| 4,982,925 | A | | 1/1991 | Hinderliter | |
| 5,037,047 | A | | 8/1991 | Chanko | |
| 5,088,420 | A | * | 2/1992 | Russell | 108/106 |
| 5,094,509 | A | * | 3/1992 | Bolzacchini | 297/23 X |
| 5,123,697 | A | * | 6/1992 | Szczurek | 297/23 |
| 5,511,855 | A | * | 4/1996 | Miles | 297/338 X |
| 5,553,921 | A | | 9/1996 | Schenk | |
| 5,609,390 | A | * | 3/1997 | Takafuji | 297/55 |
| 5,725,280 | A | * | 3/1998 | Kushnir | 297/423.44 |
| 6,105,719 | A | * | 8/2000 | Lensing | 182/116 |
| 6,561,582 | B1 | | 5/2003 | Steadman | |
| 6,595,589 | B2 | * | 7/2003 | Cochran | 297/423.11 |
| 6,684,431 | B2 | | 2/2004 | Splane | |
| 6,945,606 | B2 | * | 9/2005 | Ponticelli | 297/337 |
| 2006/0186282 | A1 | | 8/2006 | Ko et al. | |
| 2007/0043308 | A1 | | 2/2007 | Lee | |
| 2011/0062753 | A1 | * | 3/2011 | Kennedy et al. | 297/338 X |

* cited by examiner

WORKER'S BODY SUPPORT

CROSS-REFERENCE TO RELATED APPLICATION

This application is based upon provisional application Ser. No. 61/172,850, filed Apr. 27, 2009, all of the details of which are incorporated herein by reference thereto.

BACKGROUND OF THE INVENTION

There are various conditions in which a worker must perform his or her services in tight quarters and must remain in a tight or cramped position. For example, in the welding of pipes, such as metal pipes, a pipefitter would be required to place the pipe in a condition for later welding by a welder. Quite often the environment where this work takes place is not necessarily a clean open environment. In most cases, it is less than friendly to the human environment and could be in the worst possible places in the process piping. It is often difficult for the worker, such as the pipefitter or welder, just to get to the designated location. Once there, it is difficult for the worker to be able to move and manipulate the tools properly. It is necessary for the worker to twist and turn or try to find some position which is most comfortable although even such "most comfortable position" would still be very uncomfortable. Even where the work is not done in tight quarters, a worker may be required to remain in an uncomfortable position during an extended period of time.

It would be desirable if some type of body support could be provided to relieve some of the discomfort that a worker faces, whether the worker is a pipefitter, welder or any other type of worker particularly one who is required to perform the work in close cramped quarters or to be in an awkward position for an extended time.

SUMMARY OF THE INVENTION

An object of this invention is to provide a worker's body support which can be used to relieve discomfort in various work conditions.

A further object of this invention is to provide such a body support which is lightweight so that it can be easily moved and which is readily and quickly adjustable to accommodate the particular work environment.

In accordance with this invention the body support, in its preferred practice, includes a base assembly or frame which would lie directly on the floor. An upright assembly or frame is pivotally mounted to the base assembly and is locked in one of a plurality of different orientations through use of angular adjustment structure which is pivoted to the base assembly and which is selectively engaged with the upright assembly in one of a plurality of sets of notches to control the angular orientation of the upright assembly. A seat is secured to the upright assembly and is movable to different positions.

THE DRAWINGS

DETAILED DESCRIPTION

Figure 1:
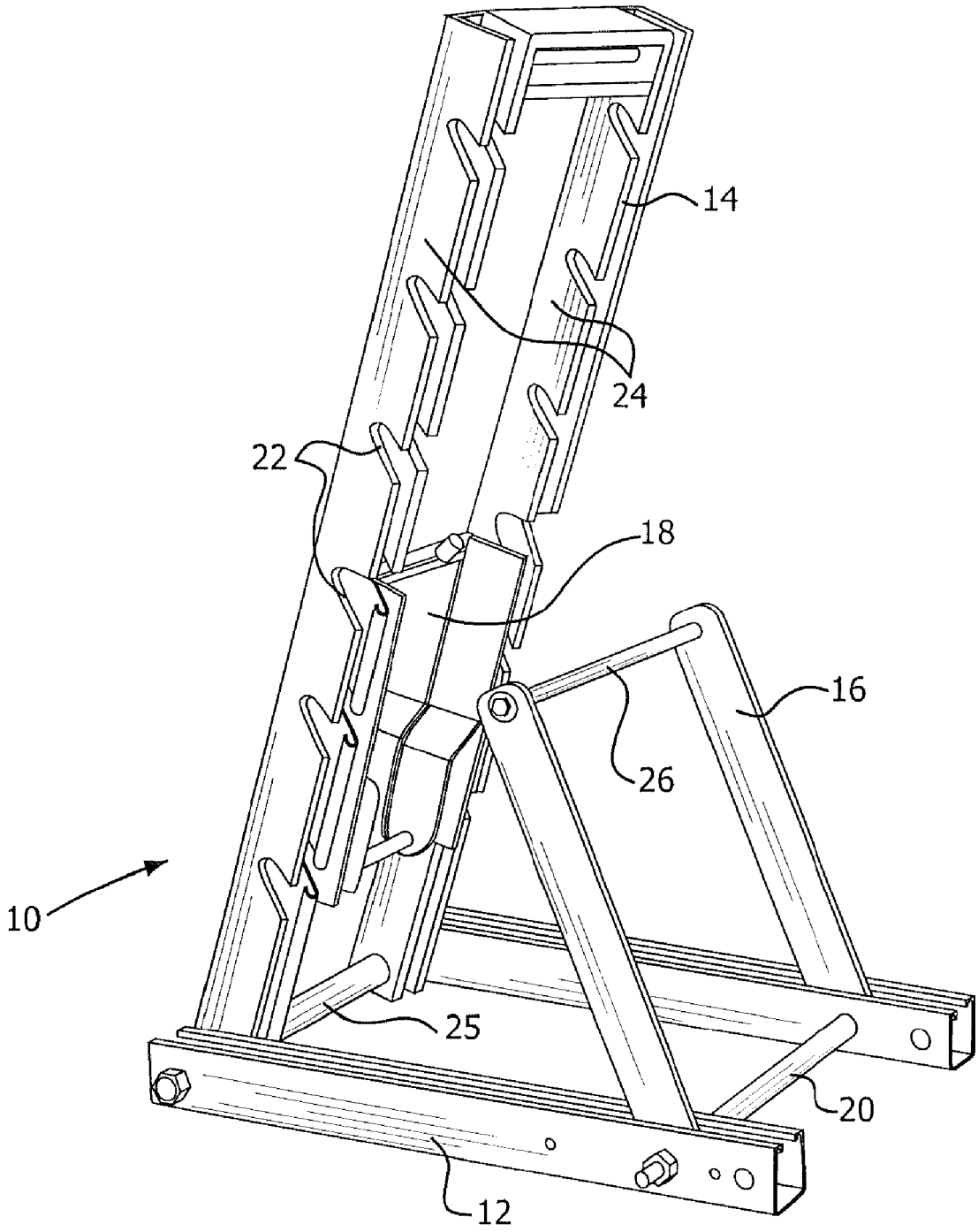
FIG. 1 is a perspective view of a worker's body support in accordance with this invention in a position before the angular adjustment structure has been mounted to the upright assembly.

FIG. 1 illustrates the basic components of a worker's body support 10 in accordance with this invention. As shown therein a base assembly 12 comprises a frame formed by a pair of spaced parallel channel members having an upright support assembly 14 pivotally connected at its lower end to an end of the base assembly 12. The upright assembly or frame is locked in one of a number of selective positions by engagement with an angular adjustment structure 16. FIG. 1 also illustrates a seat 18 mounted to the upright assembly 14.

Any suitable techniques may be used for mounting the upright support assembly at different orientations. In the embodiment illustrated in FIG. 1 the angular adjustment structure 16 includes a pair of bars or legs mounted to pivot rod 20 at the end of the two channel members which form base assembly 12. This end is opposite of the end of the base assembly 12 where the upright assembly 14 is mounted. As is apparent, upright assembly 14 is provided with sets of downwardly inclined slots or notches 22 in each of the channel members 24 of the upright assembly 14. The channel members 24 are connected together at their upper end to form a frame against which the worker's body could be supported. The upright assembly 14 is pivoted about a main pivot rod 25 so that the rod 26 spanning the bars of angular adjustment structure 16 can enter a selected set of the notches 22 thereby firmly mounting the upright assembly 14 in the desired inclination.

Figure 2:
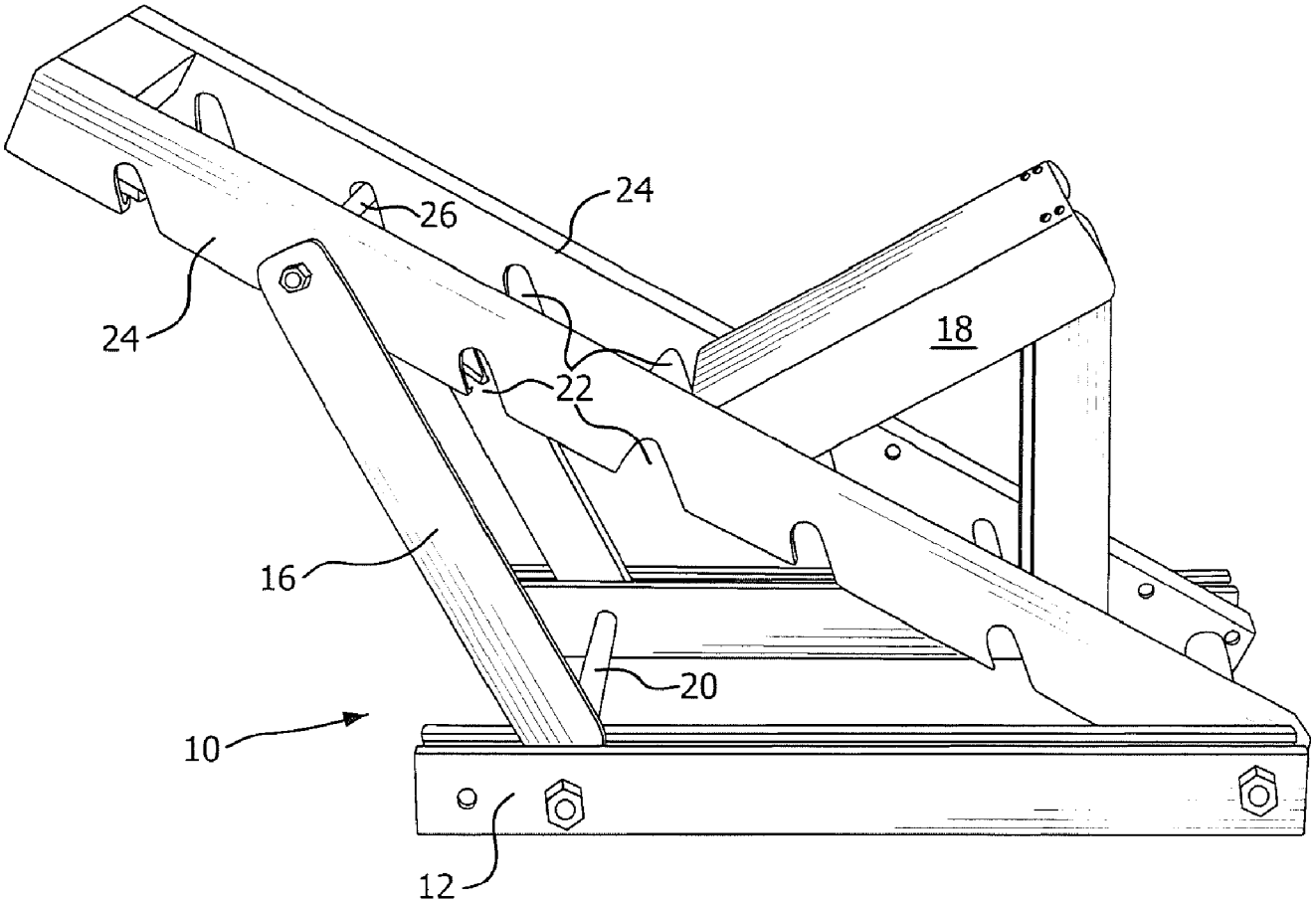
FIGS. 2-3 are perspective views of the worker's body support in different angular orientations.
Figure 3:
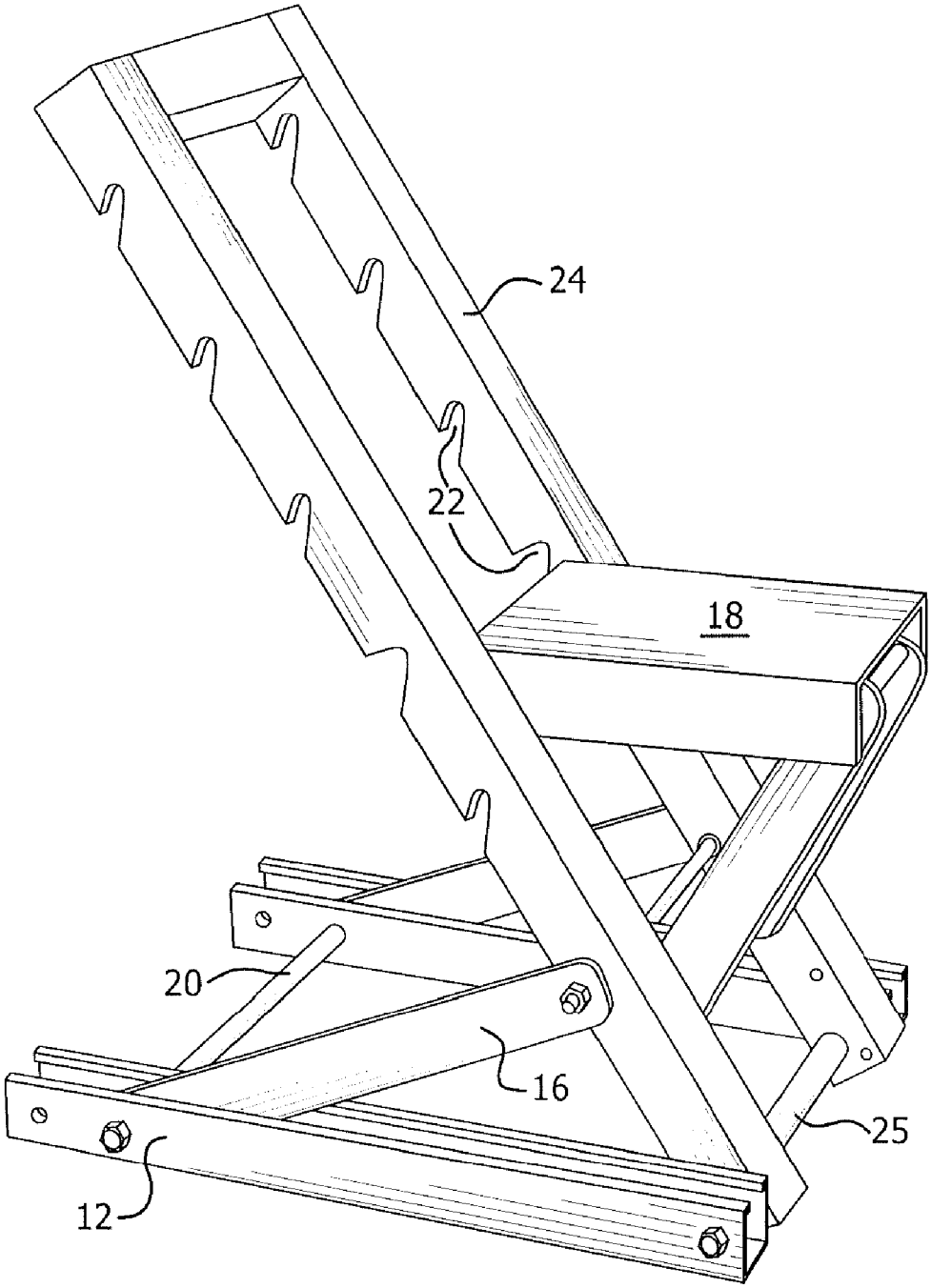

FIGS. 2 and 3 illustrate two different angular orientations of the upright assembly 14. These figures also show the seat 18 in different angular orientations. The provision of a seat is particularly advantageous in that it serves a multiple of functions. One function, of course, would be to relieve discomfort by providing a member on which the worker may sit. Additionally, however, the seat acts as an anchor in that the weight of the worker on the seat tends to prevent any sliding or undesired movement of the body support 10.

Figure 4:
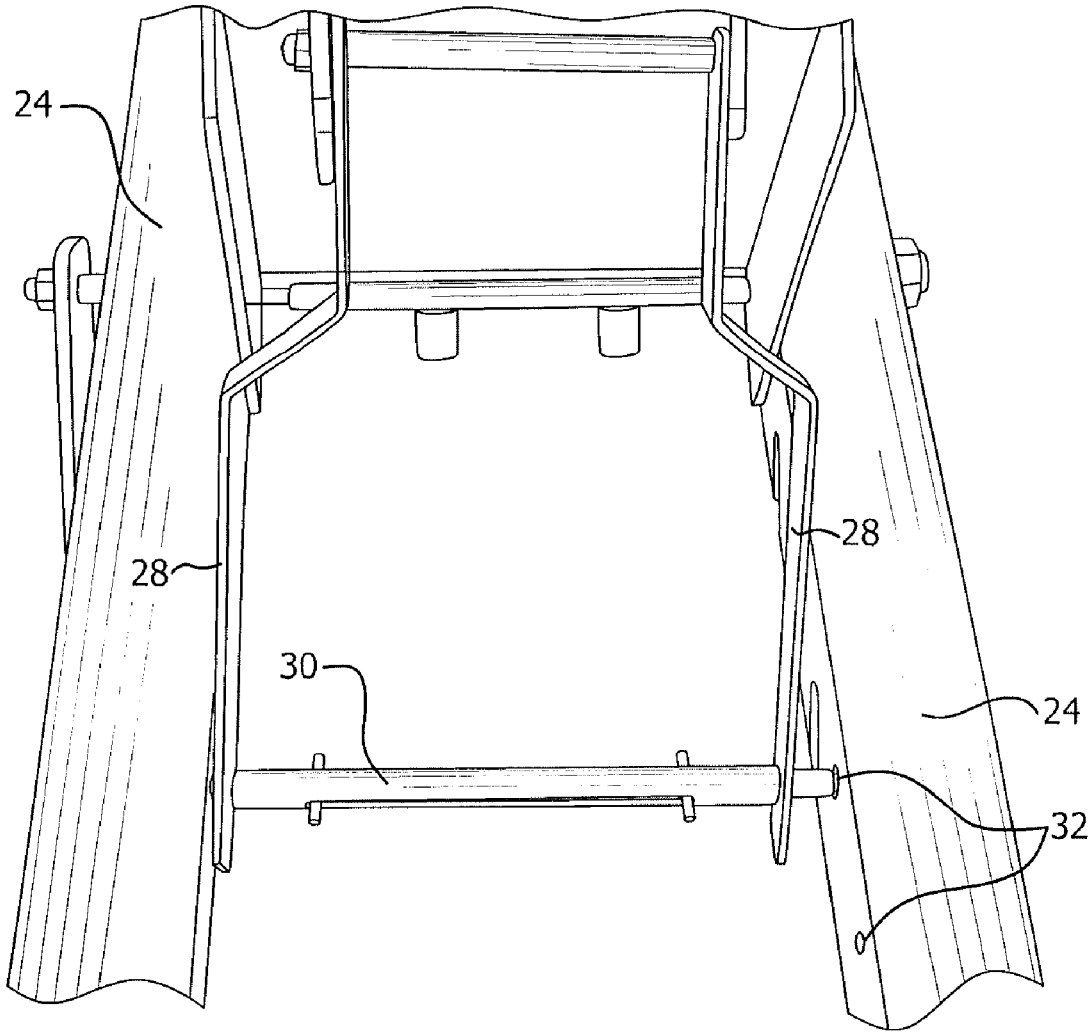
FIG. 4 is a front elevational view showing a portion of the worker's body support which includes the underside of a seat.
Figure 5:
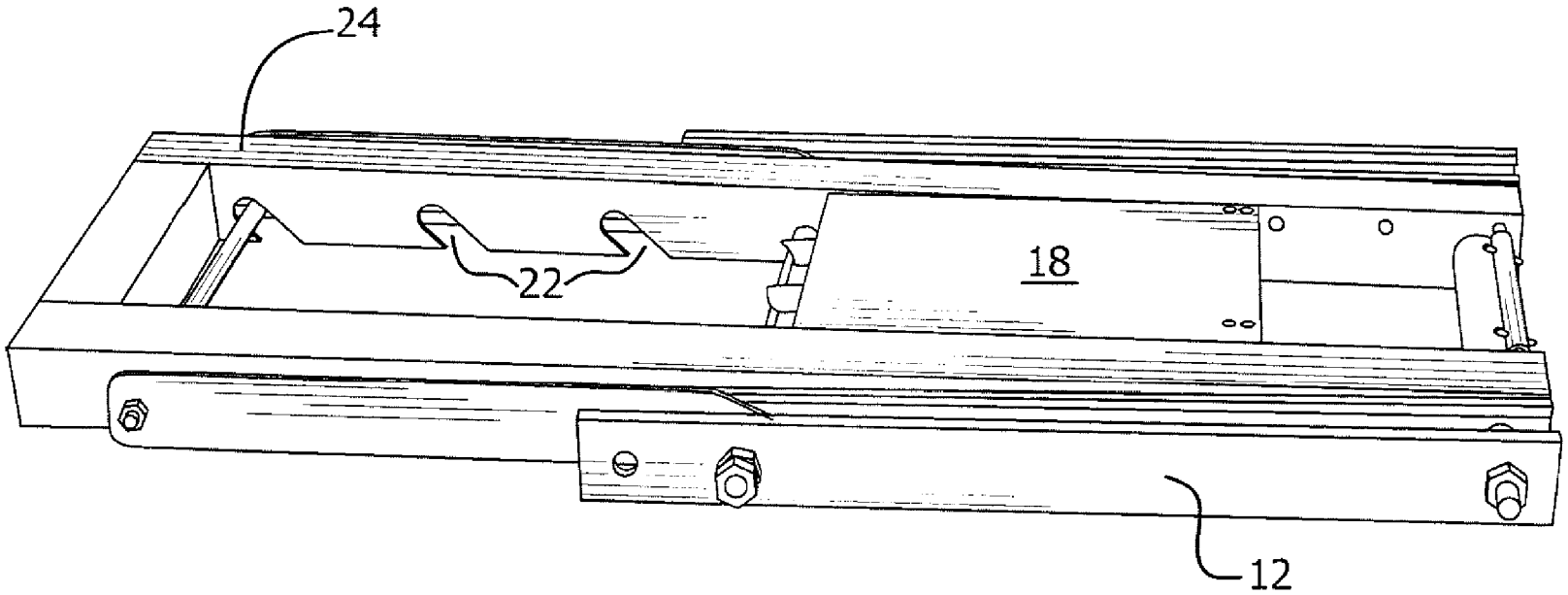
FIG. 5 shows the worker's body support of FIGS. 1-4 in its flat storage condition lying horizontally on a floor.

In the embodiment illustrated in FIGS. 1-7 the seat is adjustably secured to the upright assembly 14 in any suitable manner. For example, FIG. 4 illustrates a pair of legs 28 pivotally mounted to the channel members 24 of the upright assembly 14 through use of a rod 30 located in one of a series of holes 32 in the inner side of each channel member. The upper end of each leg 28 is pivotally mounted to the underside of the seat 18. By selecting the set of holes 32 for the pivot rod 30 at the lower end of legs 28, the orientation of the seat 18 is angularly adjustable.

Figure 14:
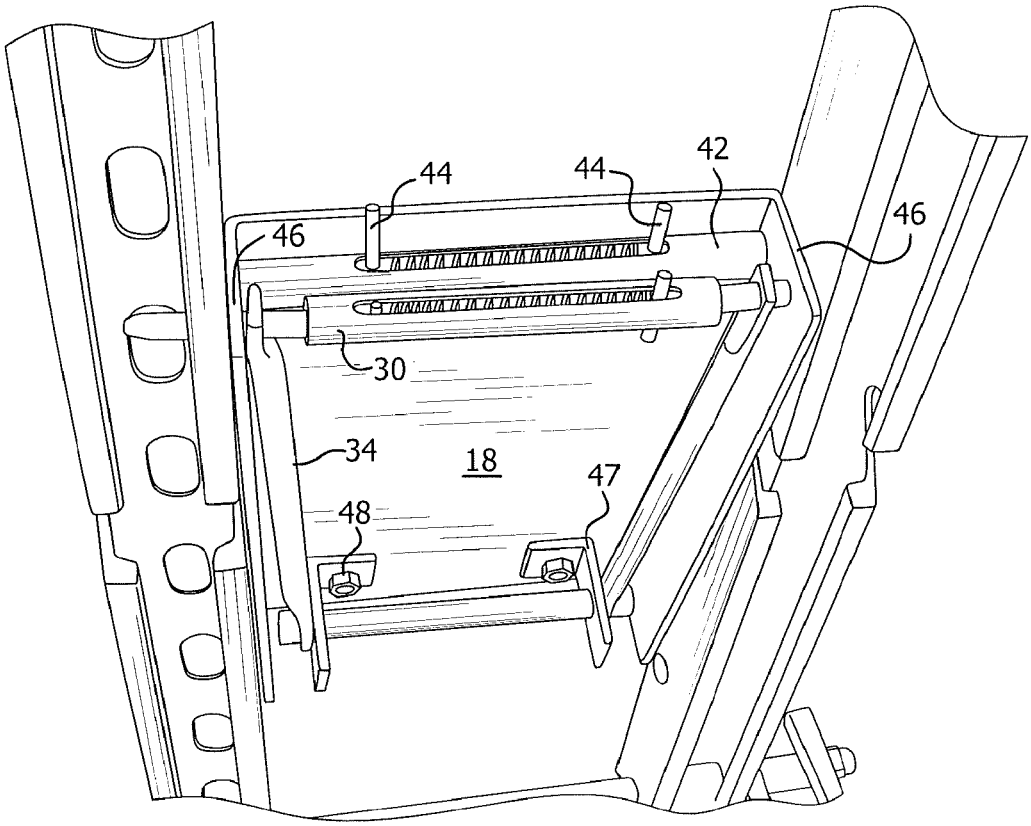

FIGS. 8-15 illustrate a preferred practice of this invention which is based upon the practice of FIGS. 1-7. Thus, the same numerals will be used for the same parts. The embodiment of FIG. 8-15 is particularly preferred because of the structure used for adjusting the location and orientation of the seat 18. As illustrated in, for example, FIGS. 9 and 11-12 instead of having the seat adjusted through the use of bars, rods 34 are used. As shown in, for example, FIG. 12 the pivot rod 30 is a sleeve which includes a pair of spring loaded pins 36 biased by central spring 38 to urge the pins 36 outwardly. The pins 36 are connected to rod-like tubular lock members 40 which are selectively insertable in an appropriate set of holes 32 on the inner wall of channels 24. By squeezing the pins 36 together, the locking rods 40 are disengaged from the holes 32 which allows the legs 34 to drop down. Once the seat 18 is in its desired height the legs 34 can be put at any of the sets of holes 32 below the seat. In accordance with which set of holes the user selects, the angle of the seat will thereby be determined. The seat can be set at an angle of, for example 90° to insure that the user/worker will not slide out of position or could be set at a lesser angle to whatever the worker wishes. As also shown in, for example, FIGS. 12-14 the seat 18 is detachably mounted to the channels 24 through use of a rod 42 which is a sleeve having spring loaded pins 44 which operate in the same manner as the rod 30 with its spring loaded pins 36 so that by squeezing the pins 44 together the seat 18 can be detached and moved to a different location with regard to the appropriate set of holes 32 in the inner walls of channels 24. One extreme location would be to mount the rod 42 to the lowermost set of holes 32 so that the seat 18 is directly flat on the ground. In this condition the rod 30 and the legs 34 would be mounted within the downwardly extending walls 46 of the seat 18, as shown in FIG. 14. The use of the spring loaded pins 36,44 permits the seat adjustment to be made quickly and effectively, which could be done in less than one minute.

The top of the legs 34 is supported by a clip or bracket 48 that is bolted through the front of the seat 18. Each leg 34 is mounted to a rod 49. For assembly, the rod 49 is inserted through each clip or bracket 48 and through a hole in the flattened end of each leg. Then a nut 50 is screwed onto the bolt holding the clip in place to thereby mount the upper end of each leg 34 to the underside of the seat 18. This form of mounting keeps the legs supported and gives the ability for the legs to swing or pivot to the rear of the seat where an additional hole in each seat side 46 allows the spring loaded rod 30 to be inserted and also hides the legs under the seat for folding or when the seat is in the lowermost position, as in FIG. 14.

Figure 6:
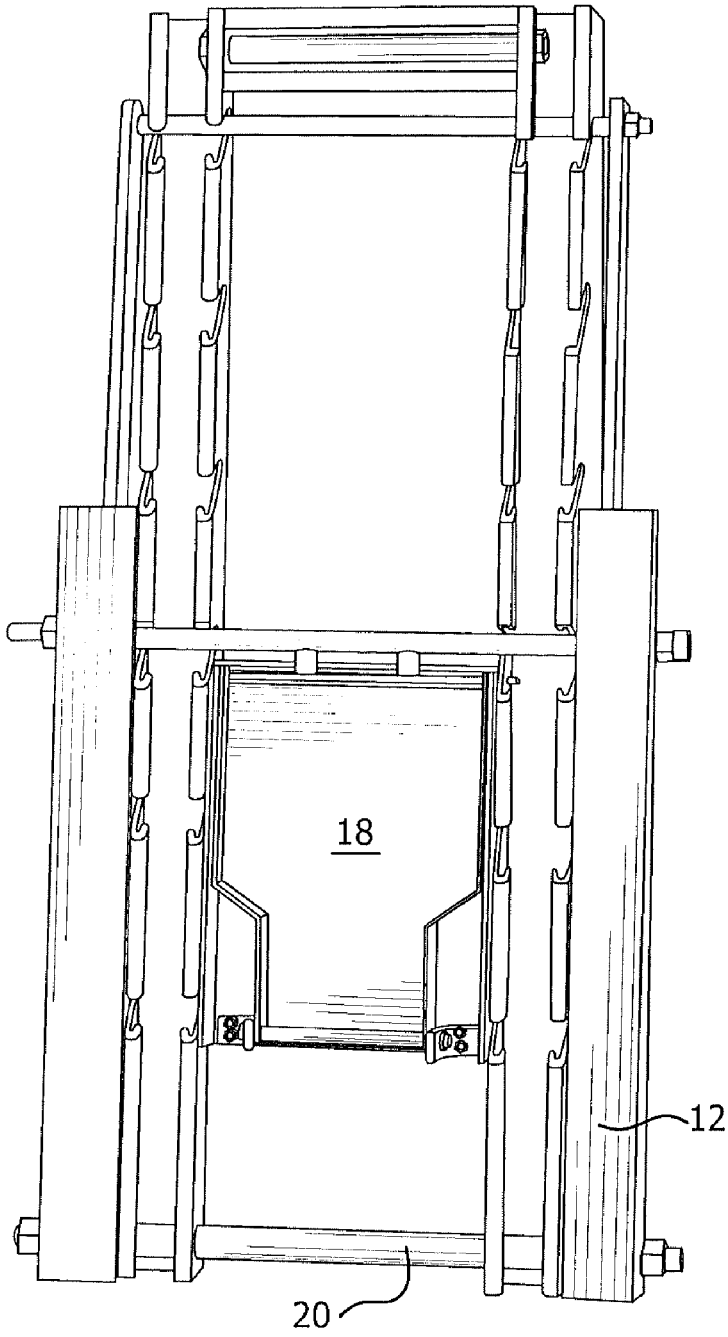
FIG. 6 is a view similar to FIG. 5 showing the underside of the stored worker's body support resting against a wall.
Figure 7:
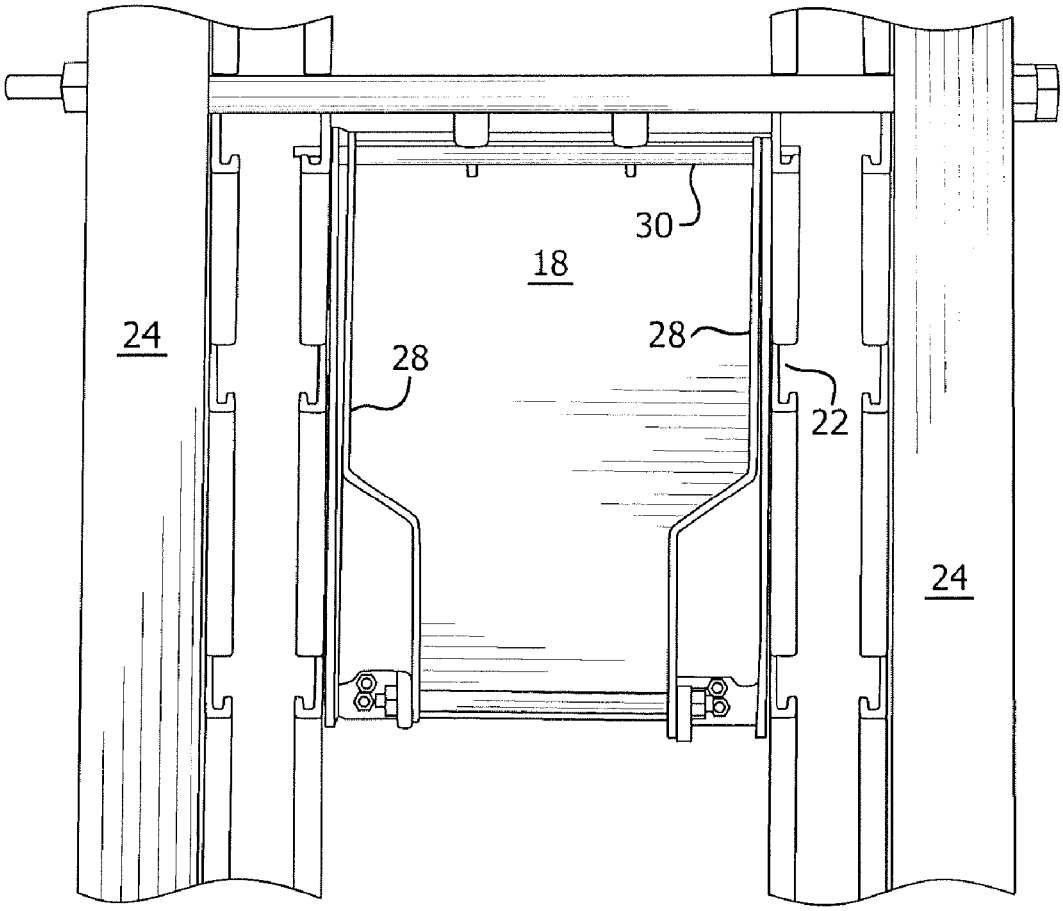
FIG. 7 shows the underside of a seat in accordance with this invention.
Figure 8:
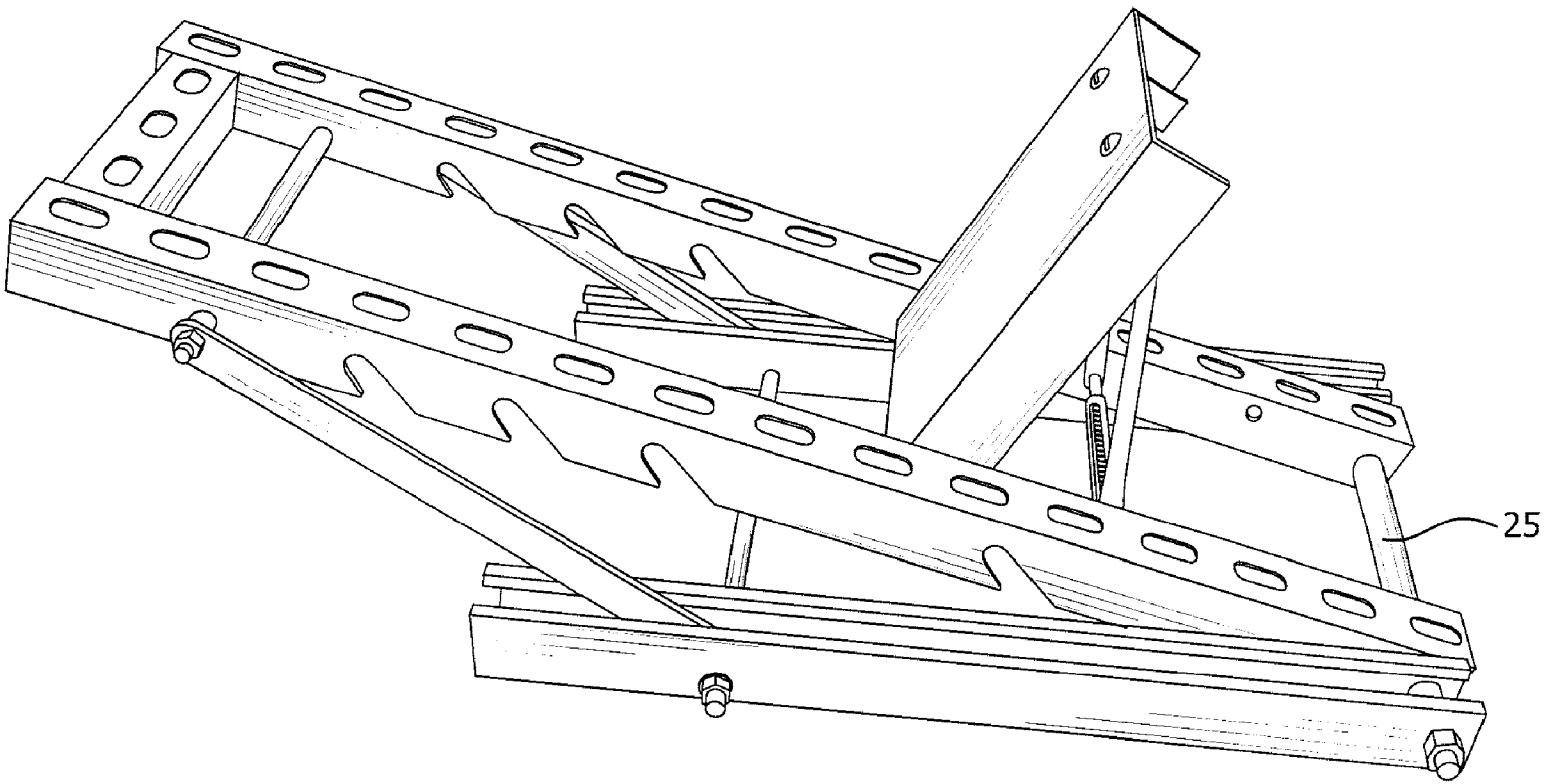
FIGS. 8-14 are perspective views of the worker's body support in different positions in accordance with this invention.
Figure 9:
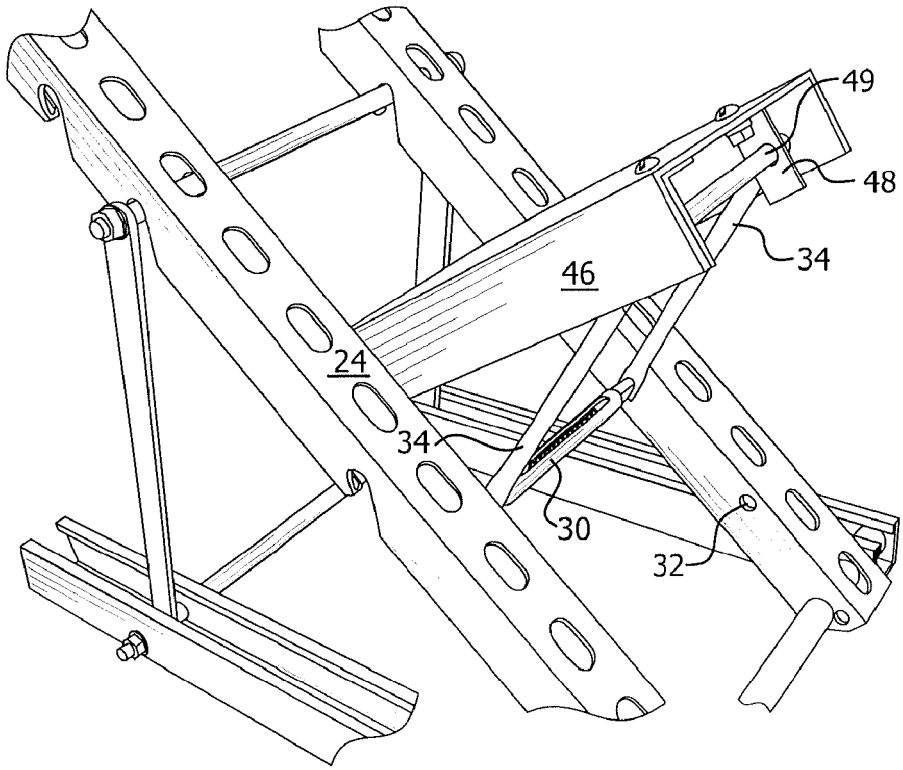
Figure 10:
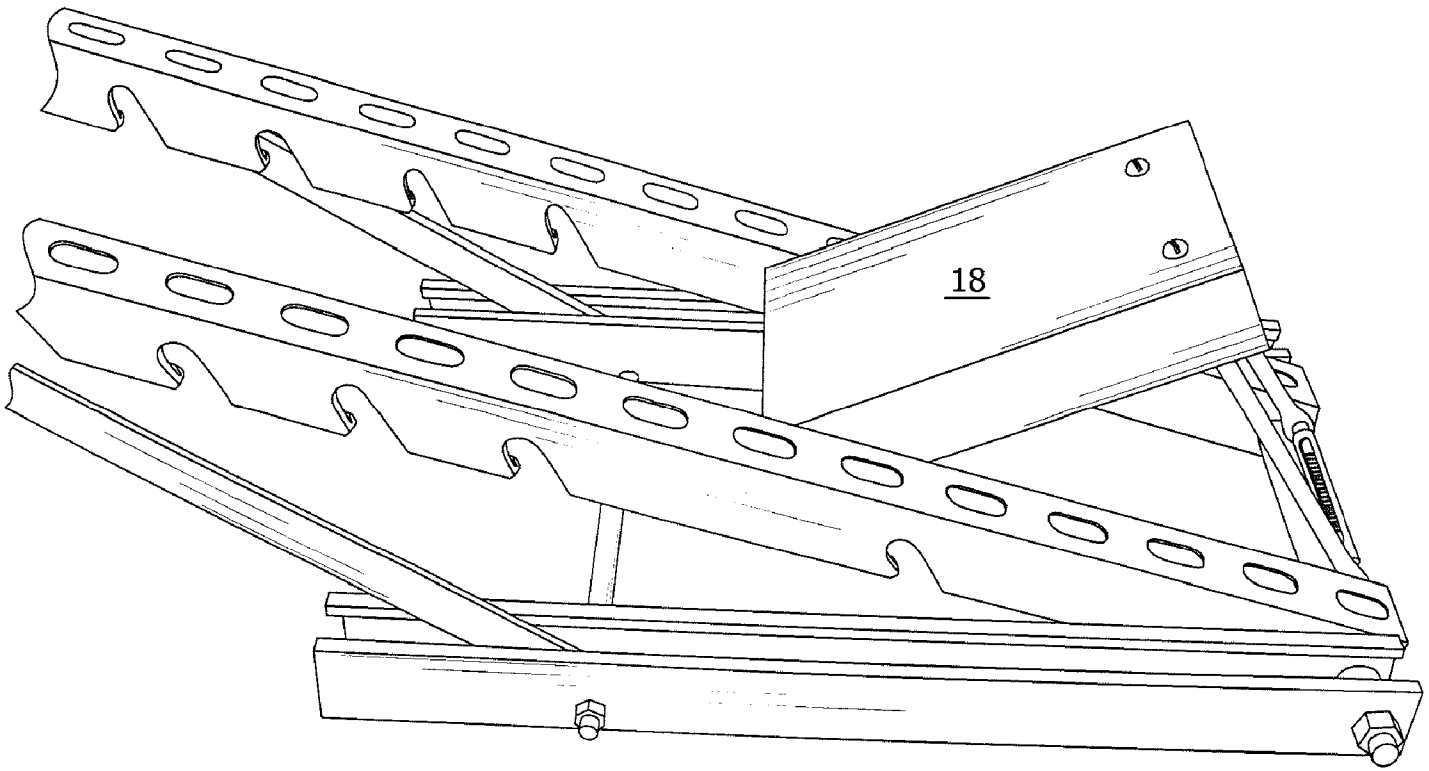
Figure 11:
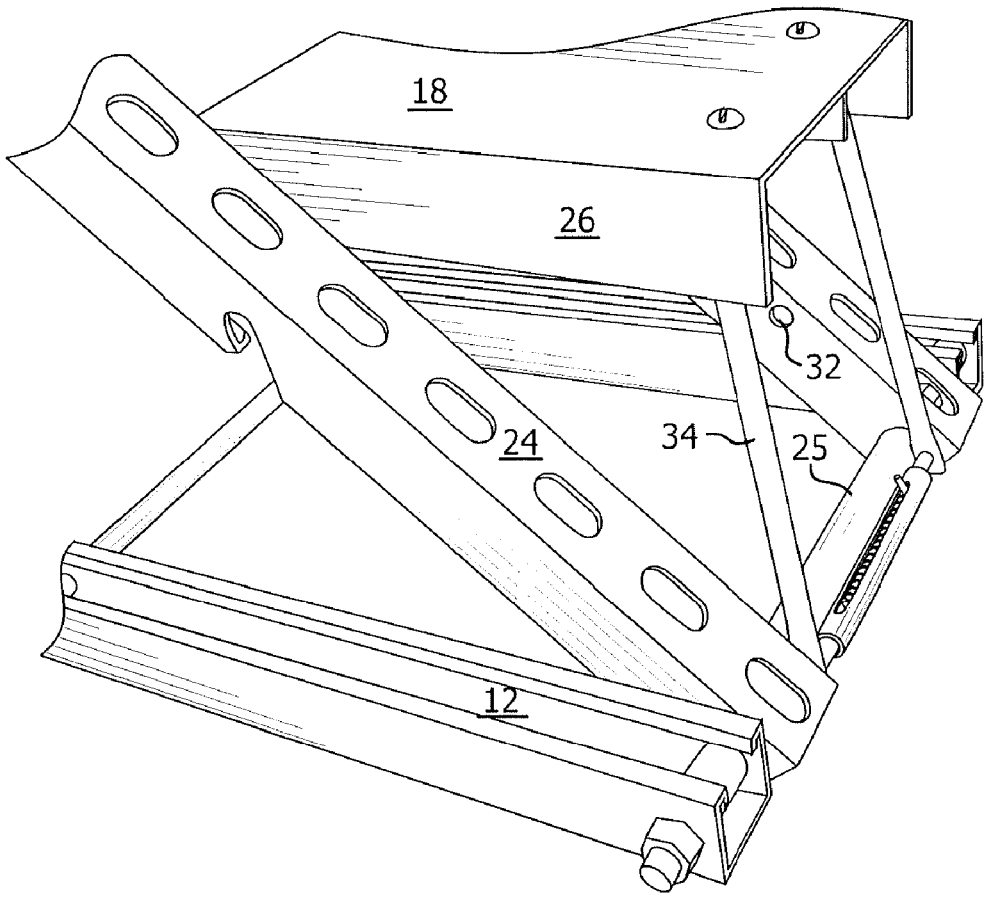
Figure 12:
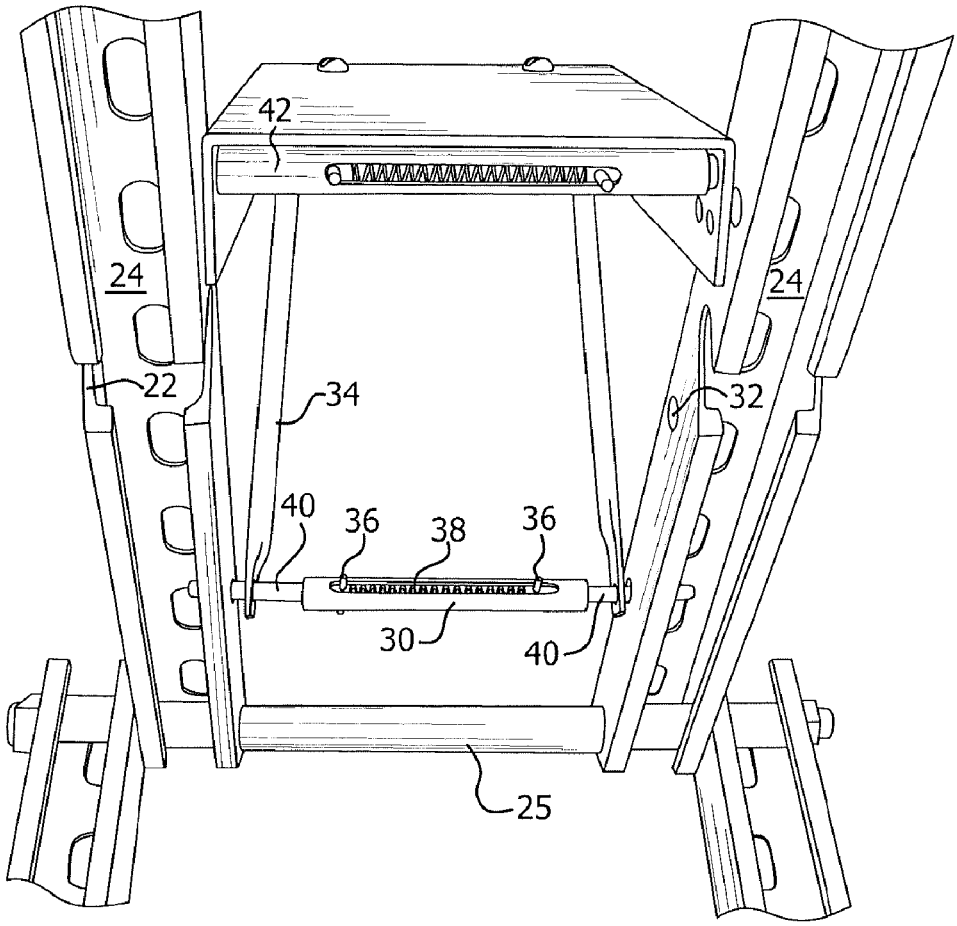
Figure 13:
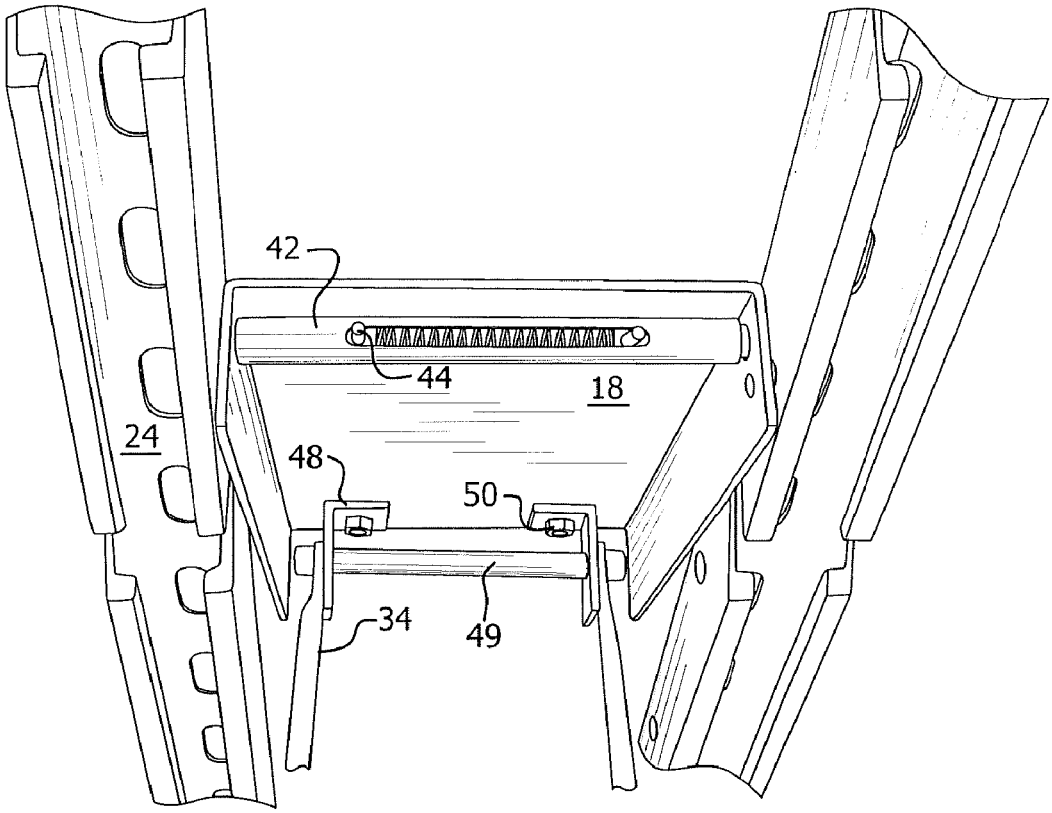

In various figures, such as FIGS. 4 and 6-7, the legs 28 are shown as bending inwardly toward each other in the front of the seat. Preferably, however each leg 34 would remain straight from front to back to give more support to the front of the seat.

Figure 15:
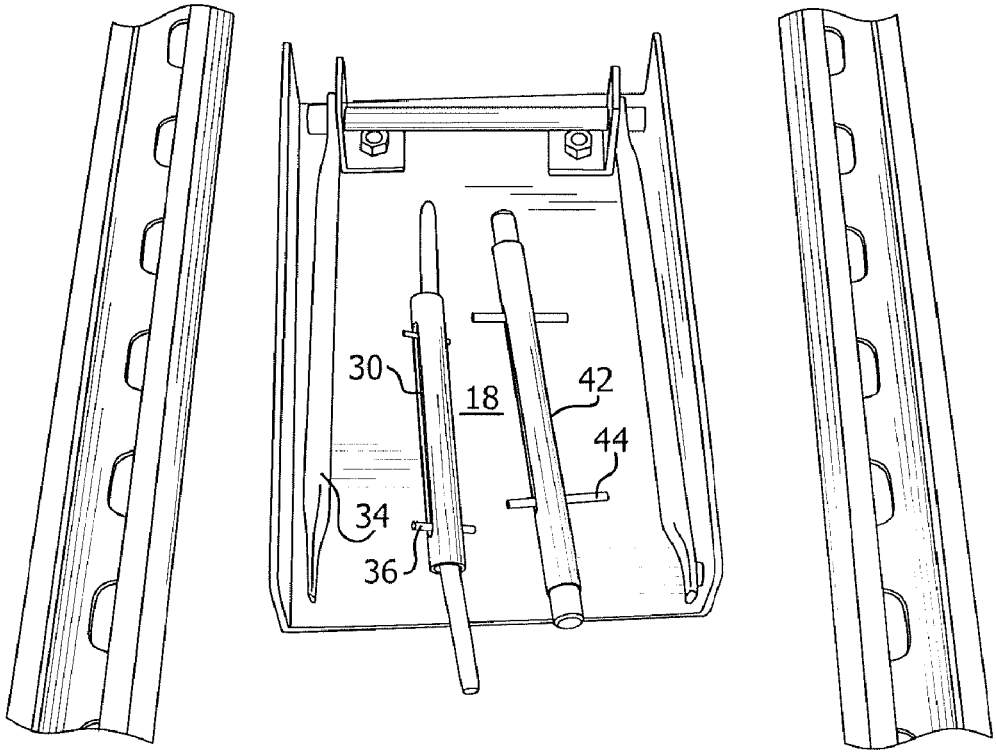
FIG. 15 is a perspective view showing the components of the seat for the worker's body support of FIG. 8-14.

FIG. 15 illustrates the various components of the seat 18 when completely disassembled.

The provision of the seat height adjustability permits a worker, such as a welder, to go from leaning against the upright assembly 14 with the seat on the ground to a position where the welder is seated on seat 18 while welding each side toward the crown on the top of a pipe instead of requiring a welder to stand and then lean over to continue welding toward the crown on the top of the pipe.

The provision of the holes 32 on the inner wall of the channels 24 permits seat orientation at various desired locations such as flat on the ground or 4 inches, 8 inches or 12 inches off the ground. In addition to permitting the angular orientation of the seat to be adjusted through the use of the spring loaded pins, it is possible to make a change in seat location in less than one minute, as previously noted.

Any suitable material can be used for the various components of device 10. Preferably, the channel members for base assembly 12 and for upright assembly 14 are lightweight aluminum. The rods for the seat 18 are preferably made of ½ inch heavy duty tubing with ⅜ inch heavy wall tubing inside of the outer rod and with a spring to keep the ⅜ inch tubing pushed out into the holes 32 of the inner frame or inner wall of the channels 24. When the seat is put to use, the smaller pins, such as ⅜ inch heavy weight tubing with 2 pieces of 5/16 solid rod inside are spring loaded and could be depressed and removed to allow the seat support legs 34 to drop out while still being connected to the front of the underside of the seat 18. If the seat remains at a particular height such as a 12 inch height the legs 34 are simply set at the desired angle with the placement of a smaller pin inserted into the desired hole 32 on the inner frame wall of channel 24.

The support 12 may be used for various workers but is particularly adaptable for use by pipefitters and welders such as to maintain a comfortable and steady position for a welder while welding which is crucial when performing, for example, x-ray welds.

The use of lightweight aluminum for the channel members of the base assembly 12 and the upright assembly 14 is particularly advantageous since it is very durable and yet light enough to be moved virtually anywhere a welder or worker goes. The size of the support 10 is also an added bonus. In one embodiment the overall size is 28 inches by 12½ inches by 2 inches. If desired, an aluminum handle can be added to the middle of the upright assembly where it balances the support 10 almost perfectly. The streamline 12½ inch width allows it to fit almost anywhere a human can fit.

Although the various figures illustrate the upright assembly 14 to be an open frame where the body contacting side of the channels 24 are spaced apart leaving an open space between the channels 24, if desired the channels could be spanned by some solid comfortable material, such as foam or fabric, to provide support and comfort to the user.

Figure 16:
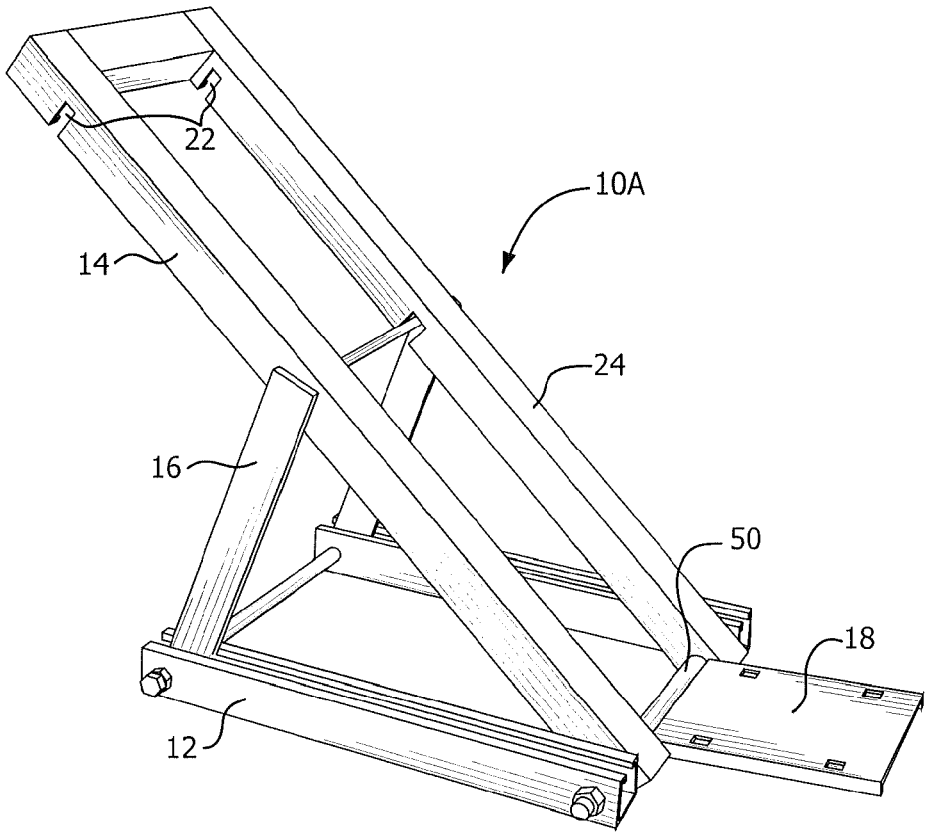
FIGS. 16-17 are perspective views of a modified worker's body support in accordance with a further embodiment of this invention showing the seat in the extended use condition.
Figure 17:
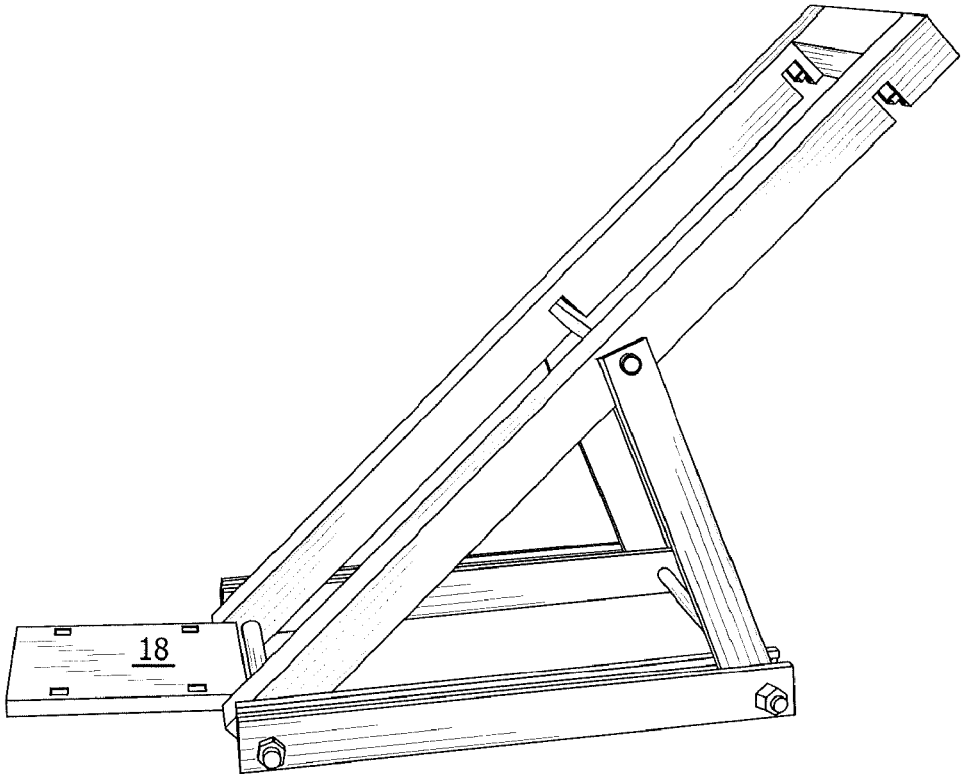
Figure 18:
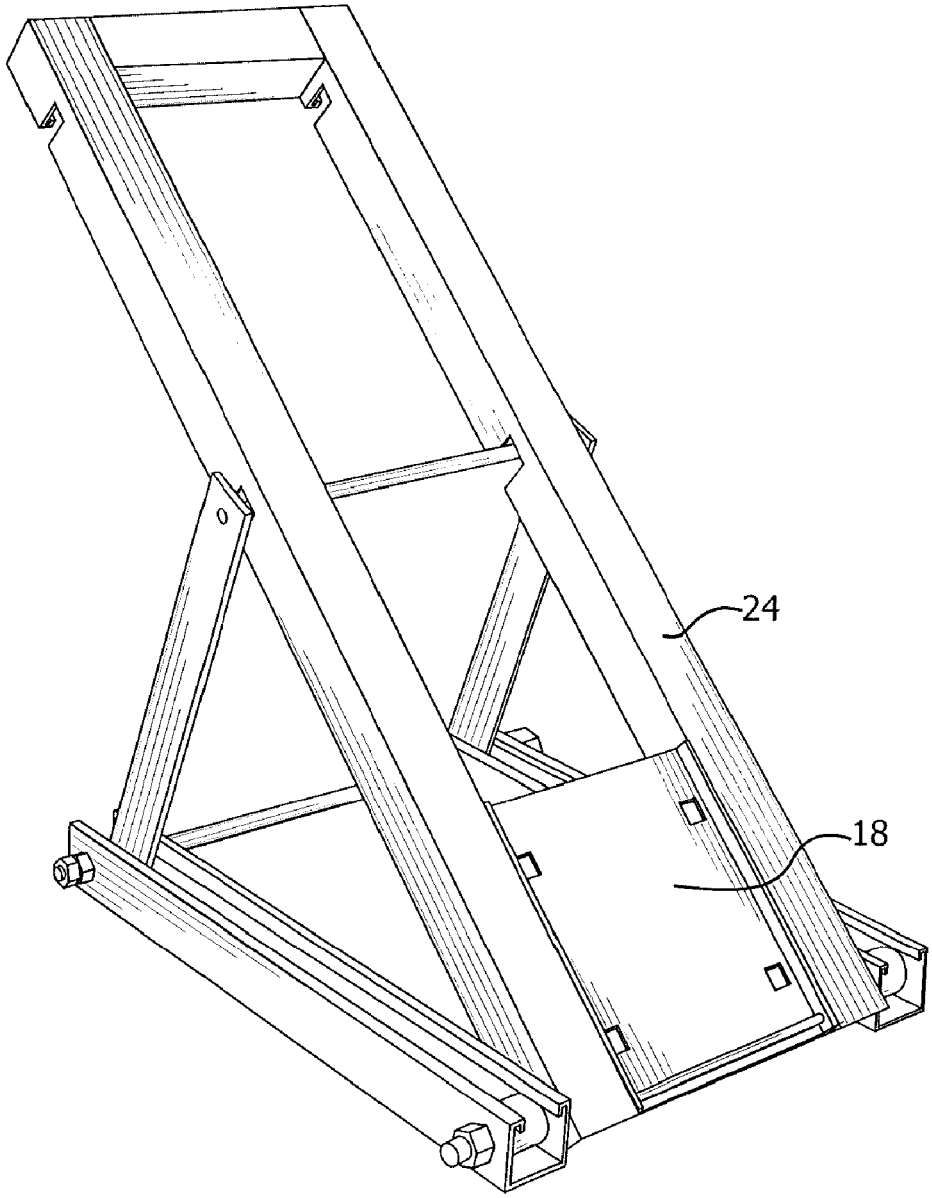
FIG. 18 is a perspective view of the worker's body support shown in FIGS. 16-17 with the seat in a stored condition.
Figure 19:
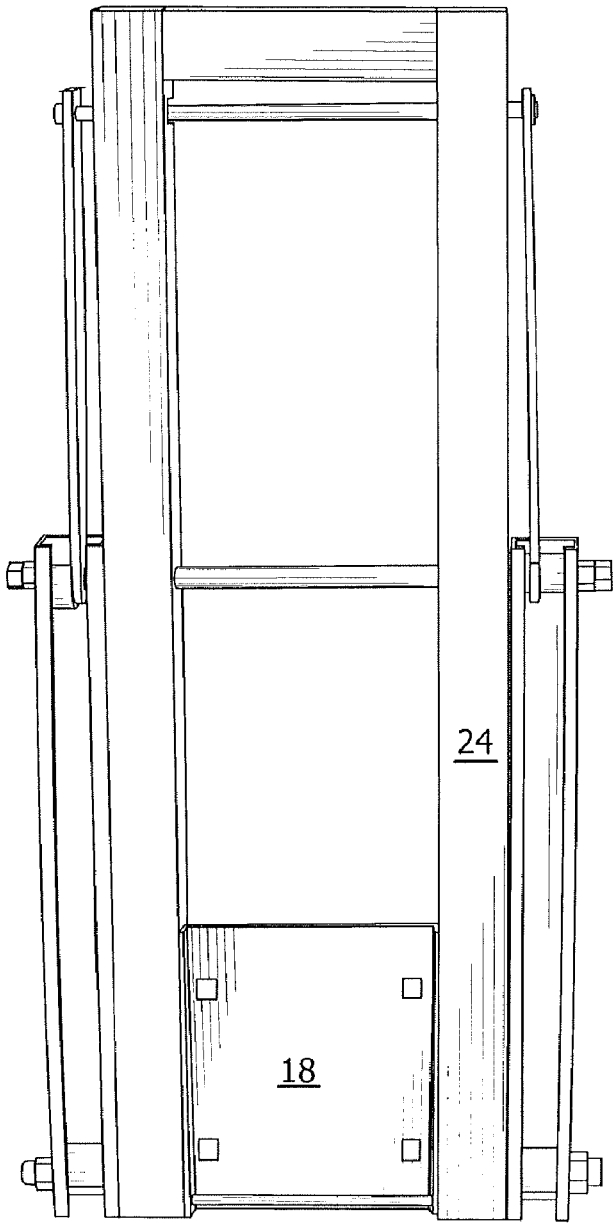
FIG. 19 is a front elevational view showing the worker's body support of FIGS. 16-18 in an upright storage condition.

FIGS. 16-19 illustrate a further variation of this invention wherein the support 10A is of more simplified construction. In that regard, the support 10A includes the base assembly 12 made of channel members and further includes the upright assembly 14 made of channels 24. The orientation of upright assembly 14 is controlled by angular adjustment structure 16 as previously described. In the support 10A, however, the seat 18 is of more simplified construction in that it is pivoted to rod 50 mounted to and spanning across the bottom of channels 24. Thus, seat 18 is movable to one of two positions. FIGS. 16 and 17 illustrate seat 18 in its use position where it is pivoted outwardly to be generally horizontal. FIG. 18 shows seat 18 pivoted to the storage condition disposed within the channels 24. Such storage condition is also shown in FIG. 19.

Figure 20:
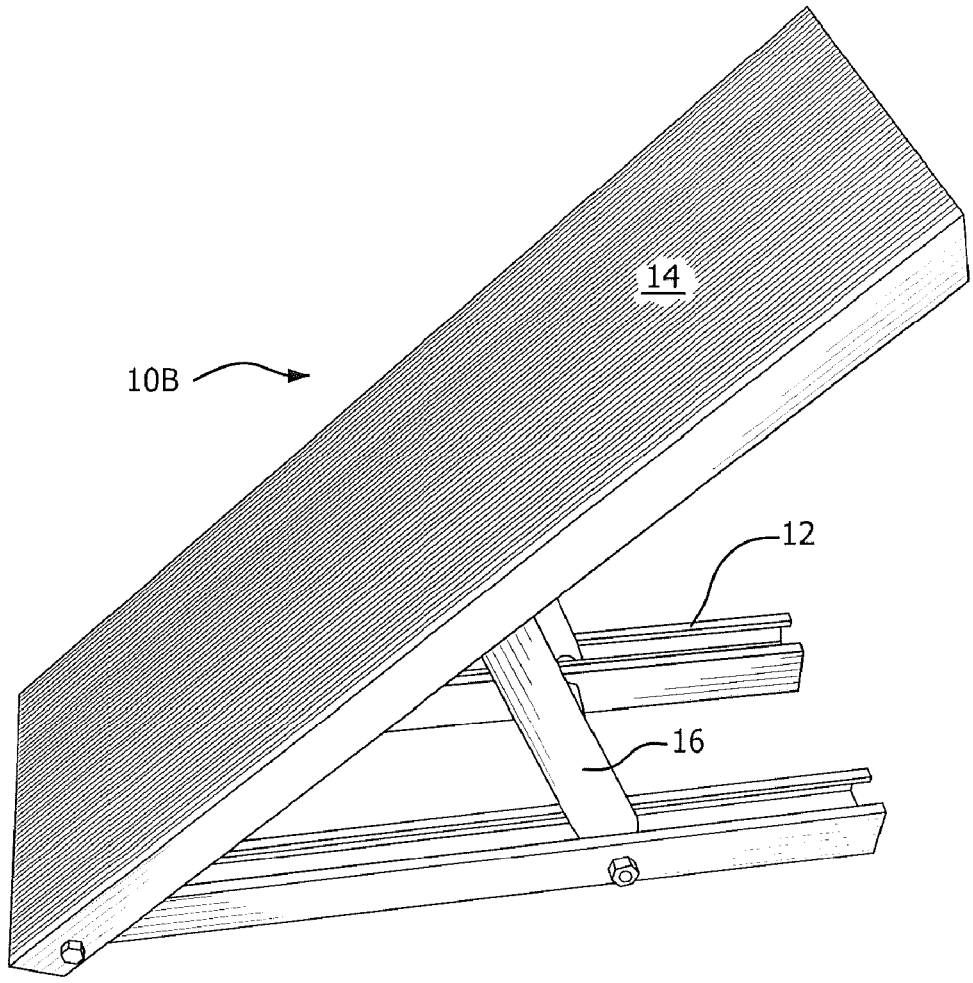
FIG. 20 is a perspective view of a worker's body support in yet another embodiment of this invention.
Figure 21:
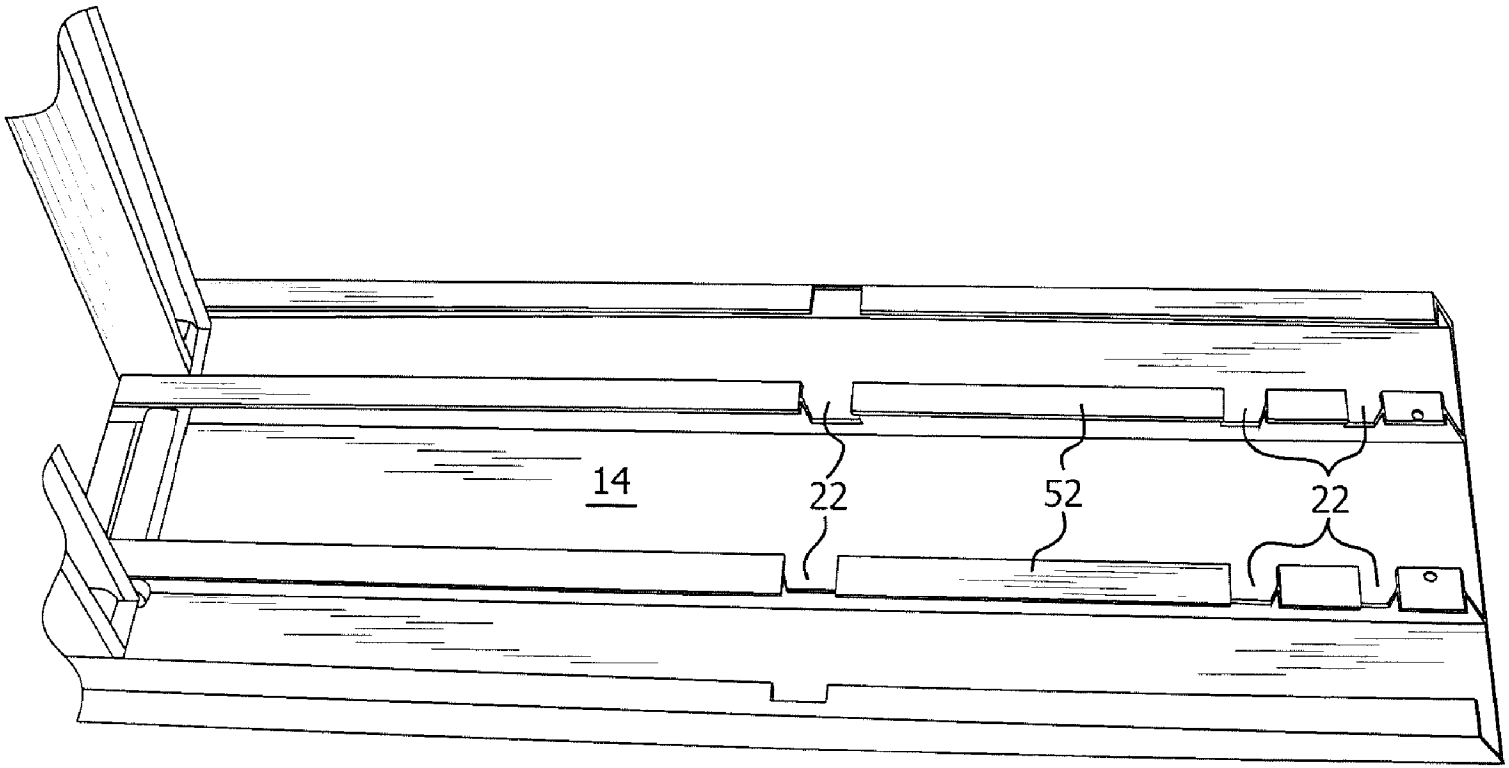
FIG. 21 shows the underside of the upright assembly in the embodiment of FIG. 20.
Figure 22:
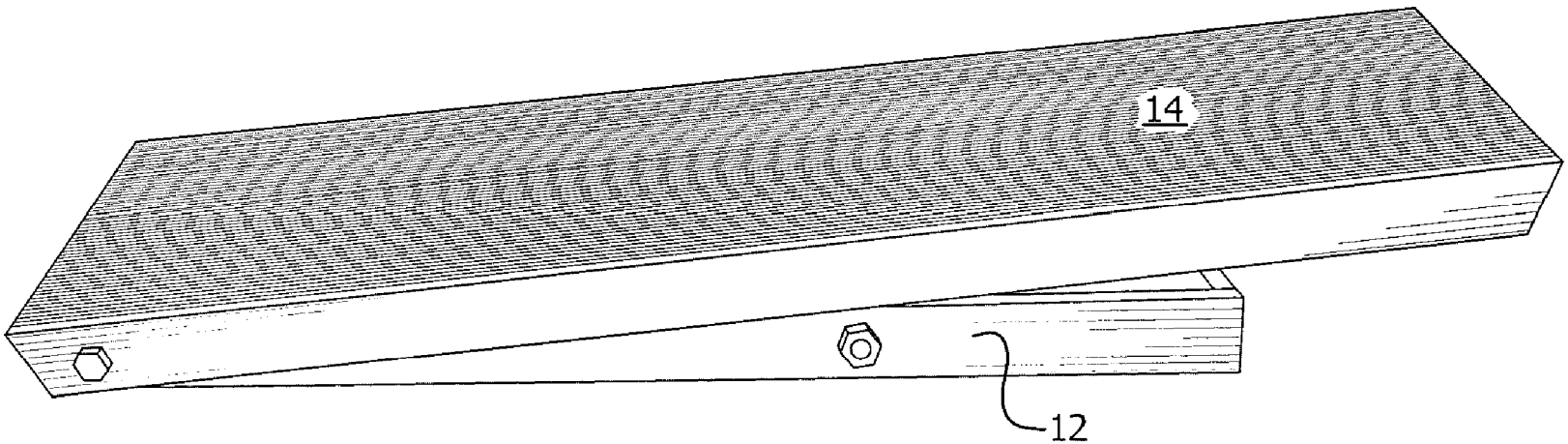
FIG. 22 is a perspective view of the worker's body support shown in FIGS. 20-21.

FIGS. 20-22 illustrate yet a further form of support 10B which includes as its basic structure base assembly 12, upright assembly 14 and angular adjustment structure 16. In this embodiment, however, upright assembly 14 is a solid one piece member having longitudinal ribs 52 as best shown in FIG. 21. Ribs 52 contain the notches or slots 22 which would be engaged by angular adjustment structure 16. The one piece solid member provides continuous support throughout rather than the type of support from spaced channels.

As is apparent, the various forms of body support are particularly adaptable to be used by workers, such as pipefitters or welders, in cramped conditions or where the worker is required to be in an awkward position for a prolonged period of time. In the preferred practices of this invention the incorporation of a seat as part of the support adds to the comfort of the worker and enhances the stability of the support by functioning to anchor the support in place.

What is claimed is:

1. A worker's body support comprising a base assembly for resting on a surface, an upright assembly pivotally mounted at its lower end to said base assembly, an angular adjustment structure pivotally mounted at its lower end to said base assembly, said upright assembly having a set of spaced locking elements spaced along the length of said upright assembly, said angular adjustment structure being selectively engageable with one of said locking elements to control the angular orientation of said upright assembly, a seat having an inner end and an outer end, said inner end being pivotally mounted to said upright assembly at first a location along the length of said upright assembly, at least one leg pivotally mounted to an underside of said seat at said outer end of said seat, and said at least one leg pivotally mounted to said upright assembly selectively at a plurality of locations below said first location whereby the angular orientation and the location of said seat is independent of the angular orientation of said upright assembly.

2. The support of claim 1 wherein said seat is detachably mounted to said upright assembly.

3. The support of claim 1 wherein said seat is selectively adjustably mounted at a plurality of locations along the length of said upright assembly.

4. The support of claim 3 wherein said upright assembly comprises a frame having two spaced parallel sides, and said seat being mounted between said sides.

5. The support of claim 4 wherein said seat is mounted to said upright assembly with a position of non-use being wherein said seat is completely within and parallel to said spaced parallel sides.

6. The support of claim 4 wherein each of said sides of said frame includes sets of downwardly extending exposed notches which comprise said locking elements, said angular adjustment structure comprising an assembly having a pair of spaced legs which are pivotally mounted at their lower ends to said sides of said frame by a pivot rod, and said spaced legs being connected at their upper ends by an upper rod which is selectively insertable into sets of said notches for controlling the angular orientation of said upright assembly.

7. The support of claim 6 wherein said at least one leg pivotally mounted to said underside of said seat comprises two legs interconnected by a second pivot rod, each of said sides of said frame including a set of spaced holes, and said second pivot rod being selectively inserted in one of said holes into each of said sides.

8. The support of claim 7 wherein a further rod is mounted to said underside of said seat and is selectively insertable into a set of said holes in each of said sides of said frame to permit said inner end of said seat to be mounted at different locations to said frame and to be detachable from said frame.

9. The support of claim 8 wherein each of said second pivot rod and said further rod is in the form of a sleeve having a set of spring actuated pins for engagement with said holes in said frame.

10. The support of claim 9 wherein said seat is movable to a lowermost position with said further rod engaged in said set of holes in said frame and with said outer end of said seat disposed outwardly away from said frame generally in line with said base assembly.

11. The support of claim 9 wherein each of said sides of said frame is channel shaped having an inner side and an outer side, said notches being formed in each of said inner side and said outer side of said frame sides, said holes being located in said inner side of each of said channel shaped frame sides and said frame sides being interconnected at their upper ends.

12. A method of supporting a worker at a welding site comprising providing the body support of claim 1 at the welding site, adjusting the angular orientation of the upright assembly, adjusting the location and angular orientation of the seat, and the worker being on the seat with the worker's body against the upright assembly while performing a working operation.

13. The method of claim 12 including detachably mounting the seat from the upright assembly, and repositioning the seat in the upright assembly for use by the worker.

14. The method of claim 12 including detachably mounting the seat from the upright assembly, and placing the seat completely within the upright assembly during a condition of non-use.

* * * * *